United States Patent [19]

Cozzi

[11] 4,359,045

[45] Nov. 16, 1982

[54] REFLUX CHAIR

[76] Inventor: Christopher A. Cozzi, 75 28 D Southwest Barnes Rd., Portland, Oreg. 97225

[21] Appl. No.: 150,068

[22] Filed: May 15, 1980

[51] Int. Cl.[3] ..... A61H 1/00

[52] U.S. Cl. ..... 128/24 R; 297/354

[58] Field of Search ..... 128/24 R, 71–74, 128/80 R, 80 A, 68; 297/373, 374, 310, 467, 377, 486, 355, 354

[56] References Cited

U.S. PATENT DOCUMENTS

| | | | |
|---|---|---|---|
| D. 180,364 | 5/1957 | Handin | 297/467 X |
| 1,113,658 | 10/1914 | Landenberger | 128/71 |
| 2,671,442 | 3/1954 | Cameto | 128/68 |
| 3,152,802 | 10/1964 | Heisler et al. | 128/71 X |
| 3,171,687 | 3/1965 | Jensen | 297/310 X |
| 3,463,145 | 8/1969 | Whitaker | 128/24 R |
| 3,759,252 | 9/1973 | Berman | 128/80 A |
| 4,033,622 | 7/1977 | Boudreau | 297/310 |

*Primary Examiner*—John D. Yasko

[57] ABSTRACT

A support platform for infants which can be inclined into varying angles to alleviate pressure in the esophageal and abdominal areas of the infant's body. The support platform is generally oblong in shape and includes a support post adapted to be straddled by the legs of the infant, and an indentation being formed in the platform to support the infant in a sitting-standing posture upon inclination of the platform. A friction pivot is provided to selectively incline the platform and infant at varying degrees relative to the horizontal. Retaining straps are provided to restrain the child on the platform and to prevent the infant's upper body from slumping forwardly and downwardly.

14 Claims, 3 Drawing Figures

REFLUX CHAIR

BACKGROUND OF THE INVENTION

1. Field of the Invention

The present invention relates generally to a medically therapeutic support platform and, more particularly pertains to an adjustable support platform or seat adapted for the treatment of gastroesophageal reflux and other childhood disorders.

The common portable baby seat is presently well known and in wide use throughout the world. The type of adjustable baby seat or support platform described by the invention relates to an entirely new concept and is not known in the prior art. A problem which is especially associated with new-born infants is medically identified as gastroesophageal reflux. Gastroesophageal reflux is a condition quite commonly encountered in new-born infants and is clinically defined as a tendency for regurgitation of gastric contents into the esophagus. The present invention is adapted to effectively aid in relieving this condition, as well as others which may result therefrom.

Ordinarily, gastroesophageal reflux occurs in new-born infants ranging in age from birth to one year and can persist for periods of anywhere from two to ten weeks. Medical studies have illustrated a tendency to reflux in 38% of new-born infants. Prior to the present invention, the accepted treatment for this condition was for the infant to remain in the hospital for a period ranging anywhere from two to ten weeks, and with the treating nurses or medical staff attempting to maintain the infant in an inclined position throughout the hospital stay by constructing make-shift supports. Due to rapidly rising hospital and medical costs this treatment is considered both uneconomical and inefficient. Research has determined that upon inclining the infant 0° to 60° relative to the horizontal plane and supporting the child in a sitting-standing type posture, this will effectively alleviate any pressure on the esophageal and abdominal areas of the infant. Pressure on this area is thought to be a prime contributing factor in causing the condition. This elevation of the infant when combined with thickened food has been shown to relieve the symptoms and distress in 90% of patients.

Further research has also shown that by inclining infants as described in this invention the more serious disorders that may develop from gastroesophageal reflux such as esophagitus, esophageal stricture and even anemia, may also be prevented. Additionally, the treatment of unrelated disorders, such as pyloric stenosis (the narrowing of the muscle tissue surrounding and controlling the broad outlet of the stomach) and hydrocipholus (excess fluid in the brain), is also improved by the use of the invention described herein. This is due to the fact that upon inclination to the proper angle, gravity alone, without any abdominal pressure, keeps the food and fluid down in the stomach. Hydrocepholus and pyloric stenosis are relieved because of the orientation of the infant's body relative to gravitational forces.

2. Discussion of the Prior Art

The inventive arrangement effectively obviates the tendency of infants to regurgitate their gastric contents into the esophagus. To effect this result, the inventive concept utilizes a unique configuration of support post and contoured indentation to support the infant on the platform. It has been found after clinical research that when supporting the infant on a platform of this type, at a particular angle to be determined for each individual infant, the infant can be supported without exerting any pressure upon the esophagus, stomach or lower esophageal sphincter. By inclining and supporting the child in such a manner, the relief of any pressure tending to act on the lower esophageal sphincter has been found to help alleviate the gastroesophageal reflux condition.

None of the prior art, of which Rocker U.S. Pat. Nos. 3,272,556, Storer 3,572,830 and Meeker U.S. Design Pat. No. 252,118 are typical, even suggests the present invention's functionality or design in treating this or other stomach-related conditions or ailments.

As illustrated in Rocker U.S. Pat. No. 3,272,556, a relatively simple arrangement is utilized to provide for an adjustable baby seat. The seat is limited to only a limited number of angles of inclinations as well as being merely a baby seat. An infant when supported in a conventional seat of this type, will not only slump forwardly, thus causing pressure to be exerted upon the esophageal area of the body, but will also cause pressure to be exerted upon the sphincter so as to induce the reflux condition. As a result of this sitting posture, the child would experience no relief from gastroesophageal reflux, because abdominal pressure would be exerted upon the torso by the legs.

Storer U.S. Pat. No. 3,572,830, also subject to the same limitations as previously mentioned with regard to Rocker, utilizes an upwardly projecting horn which is incorporated into the seat to thereby prevent the child from sliding forwardly. This horn is not used to support the child as in the invention herein described but is utilized to retain the child within the seat. The seat of Storer also contemplates much older children than the infants to which the invention is particularly applicable.

Finally, Meeker U.S. Design Pat. No. 252,118 shows a basic design for a portable baby seat. Although not particularly relevant, it is referred to as showing the state of the art with regard to portable babyseats. This particular design, as well as all of the prior art known, has all of the limitations of the Rocker patent as described hereinabove. The invention herein described allows for ease in the home treatment and care of the infant afflicted with the above-described condition as well as to provide the hospital with an improved arrangement for the care of the infant while at the hospital.

SUMMARY OF THE INVENTION

Accordingly, it is a primary object of the invention to provide a therapeutic chair or platform which is capable of supporting an infant in a sitting-standing type posture to thereby effectively alleviate any pressure in the infant's esophagus, stomach, and lower esophageal sphincter area and to thereby effectively aid in the treatment of gastroesophageal reflux and other related infant disorders.

A further object of the present invention is to provide a safe, lightweight platform which is easily adaptable to be supported on any flat surface enabling the platform to be used in any convenient location such as a hospital, home, office, or the like.

Still another object of the invention is to provide a therapeutic chair adaptable to fit a broad range of infant sizes inasmuch as that the infant disorder being treated may occur in either sex at any period within the first year of the infant's life whereby the chair must be adapted to accommodate different sizes of infants while adequately supporting each infant in the sitting-standing posture.

Another object of the invention is the provision of a therapeutic infant-supporting platform which is economical to manufacture and easily affordable by the consumer.

The present invention provides a novel arrangement for relieving pressure-occasioned disorders in small infants. Specifically, a therapeutic chair-like platform is provided which utilizes an adjustable platform tiltably mounted on a tubular base. This platform has a slight indentation near the middle thereof adapted to receive the infant's buttocks, and a support post positioned just below the indentation to provide further support to the infant when the infant is inclined at the desired angle.

BRIEF DESCRIPTION OF THE DRAWINGS

The foregoing and other objects, advantages and novel features of the inventive infant support platform will become more clearly apparent from the ensuing detailed description of an illustrative embodiment thereof, taken in conjunction with the accompanying drawings, wherein like reference numerals denote like parts throughout the various views; and in which.

DESCRIPTION OF THE PREFERRED EMBODIMENTS

Figure 1:
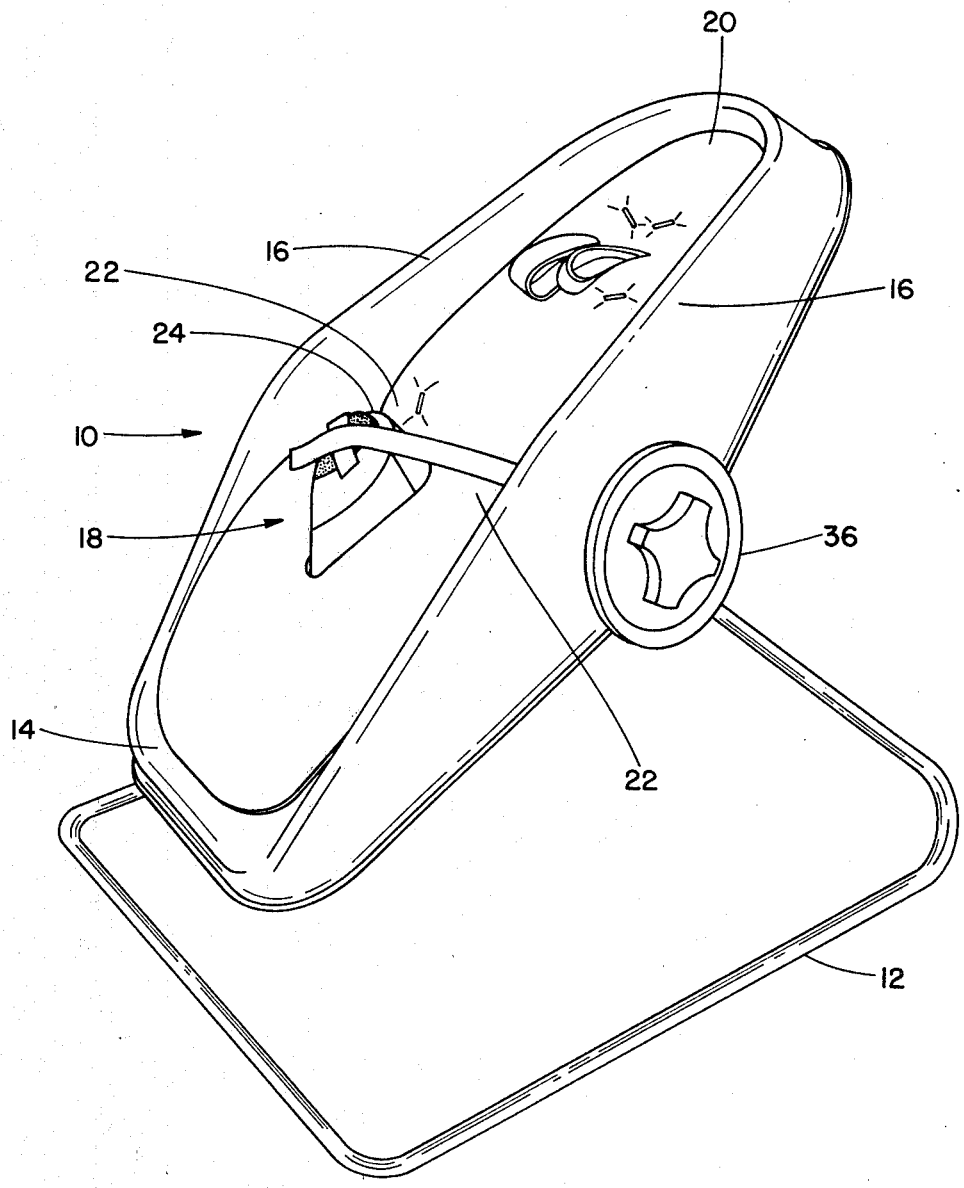
FIG. 1 is a perspective view of the support platform shown completely assembled.
Figure 2:
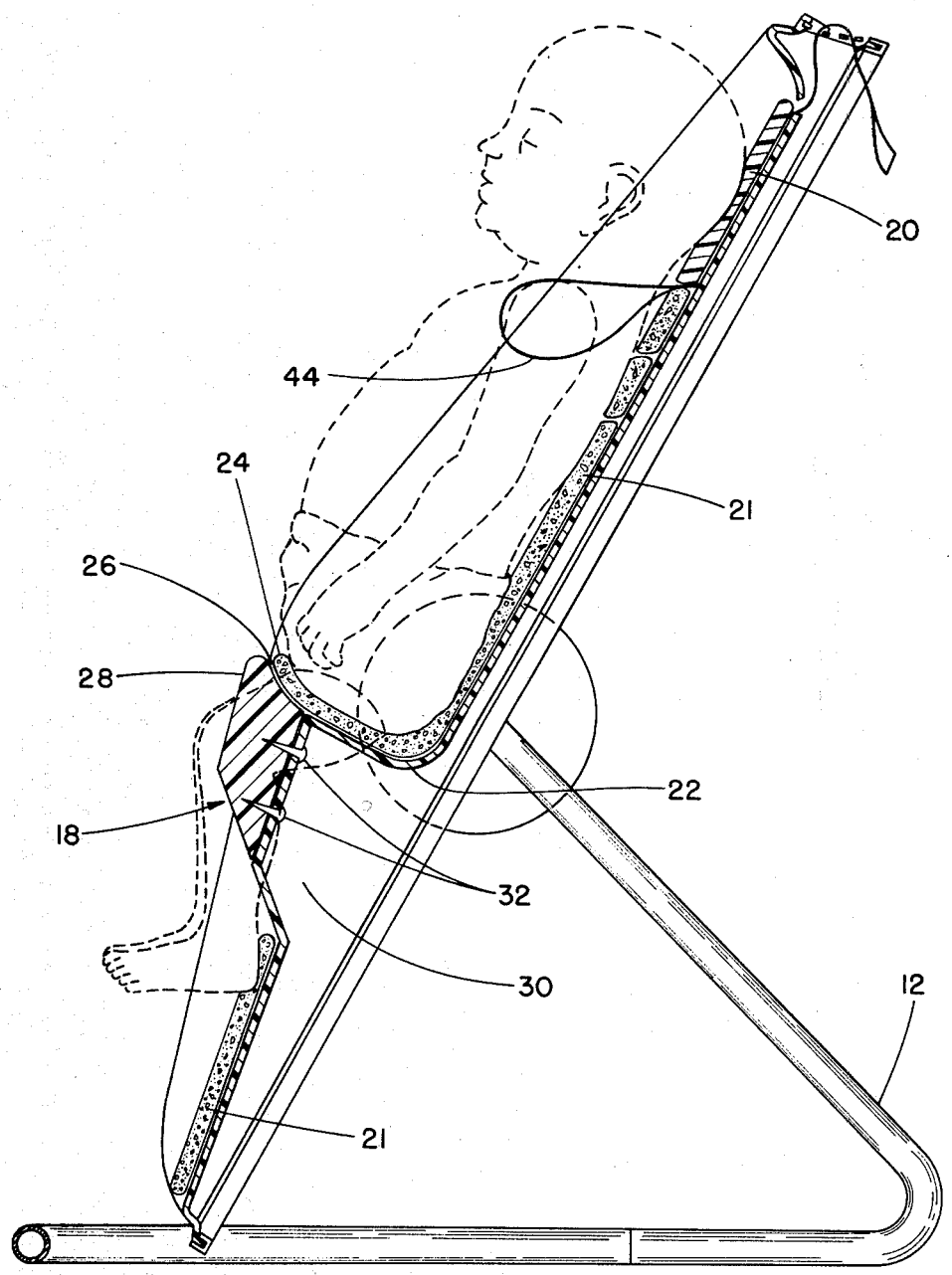
FIG. 2 is a partially broken, longitudinal sectional view of the platform, pad, support-post and tubular base.
Figure 3:
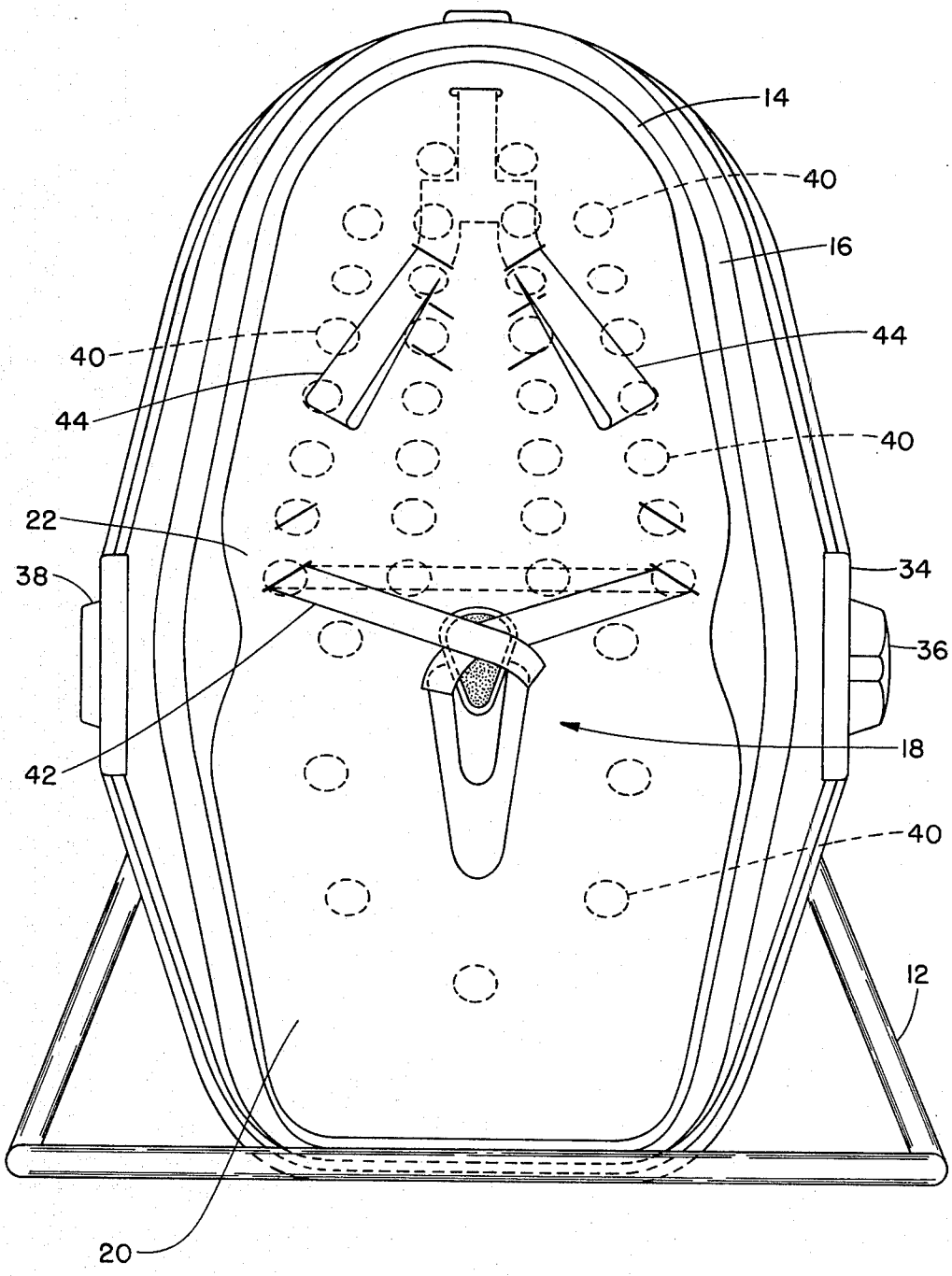
FIG. 3 is a frontal view of the assembled support platform arrangement.

Referring now in detail to the drawings, shown in FIGS. 1, 2 and 3 is a support platform 10 with a tubular base 12 attached thereto. The support platform 10 consists of a contoured support surface 14 having an oblong and generally ovoid configuration, with an upraised edge 16 forming a rim surrounding the support surface 14, and with a central support post 18. The central post 18 is located slightly downwardly from the transverse axis and is positioned on the longitudinal axis of the platform 10. The entire platform structure may be constituted of a suitable smooth-surfaced plastic material of rigid construction, and may be vacuum-formed in a manner well known in the art. A foam pad 20 which may be of a yieldably elastic or resilient plastic material or impregnated fabric resistant to moisture is positioned on the support surface 14 to thereby directly support the infant; with the foam pad 20 being shaped and sized so as to cover the entire support surface 14. The support surface 14 has a very slight indentation 22 formed therein extending transversely across and centrally along the support surface. Positioned slightly below the indentation 22 is the support post 18 which extends upwardly from the support surface 14 and projects through an aperture in the foam pad 20. The pad 20 is provided with a finger-like foam projection 24 which lies against the uppermost facing edge 26 of the support post and forms a cushioned surface against which an infant can bear without discomfort. The post 18 is positioned and utilized on the platform 10 to be straddled by the legs of the infant in order to support the infant on the platform against sliding downwardly when the platform is in an inclined position. The indentation 22 is provided so as to receive the infants buttocks to further aid in the support of the child on the platform.

An upper portion 28 of the support post 18 is detachably fastened to the main portion 30 of the support post 18 (see FIG. 2) through, preferably, the use of two screws 32. The advantage of such a detachable fastening is that this portion 28 can be easily replaced by another portion 28 of different size which can more closely conform to the infant's size, or take cognizance of the infant's growth. Therefore, the platform can be made adjustable so as to be utilized successfully over a wide range of infant sizes. Generally, the size of the platform can be of a length of 80 cm along the longitudinal centerline and a width of about 50 cm in the region of the support post.

The support platform 10 is further provided with a friction pivot 34 pivotally connecting the platform with the base 12 which enables the operator to incline the platform and the infant supported thereon to any angle between 0° and 60° relative to the horizontal about a horizontal, transverse axis. This angle of inclination is normally found through trial and error because each infant, according to size, weight and physical condition, experiences maximum relief at a different angle of inclination of the platform. However, medical studies have shown that the most preferred range of inclination is 30° to 60° relative to the horizontal, with 45° being the most preferred angle. The friction pivot 34 may be of a construction well known in the art and is generally formed of four cooperating metal plates, a high-torque knob 36 and a metal rod with an attached cap 38. This simple arrangement allows the operator, normally a parent or nurse, to easily adjust the platform 10 with infant supported thereon to the desired inclination by respectively loosening the knob 36, adjusting the tilt of the platform, and retightening the knob.

To allow the platform 10 to be used over an extended period of time, which by the nature of the disorder is generally a necessity, the platform is provided with a series of spaced ventilation holes 40. Because the infant is constantly supported on this platform in an inclined position anywhere from two to ten weeks, except for diaper change or bathing, the ventilation holes are provided so as to provide some cooling air ventilating the foam pad 20. The foam pad is also provided with a cloth covering 21 which can be easily removed and washed, thereby providing an easily cleanable and hygienic support platform which can be used for extended periods of time.

The platform is also provided with infant retaining means, preferably, a cotton strap 42 which is fastened to the platform 10 and can be secured across the infant's lower abdomen. Additionally, straps are provided to prevent the infant from slumping forwardly. These straps are fastened to the platform and are adapted to be passed through suitable apertures or slits in the foam pad 20 and either consist of an upper chest strap which can be secured across the infant's chest or may be shoulder straps or slings 44 which are attached to the platform above the infants' shoulders and are adapted to be looped around each arm at the shoulder of the infant. Through this arrangement there will be inhibited any slumping forward or downward by the infant on the platform, thereby providing effective support of the infant and relieving any pressure on the esophageal area while supported on the platform.

During use of the invention, the parent, treating nurse, or physician places the infant on the pad 20 on the support surface 14 of the platform 10 and inclines the platform with the infant thereon to the desired slope or angle. Once the optimum treatment angle is determined as herein described, normally through trial and error, the infant is then normally maintained in this position for about two to ten weeks, depending upon the physician's advice. When this support is combined with a diet of thickened food, the infant, in 90% of the cases, will be relieved of the gastroesophageal reflux condition. Once the sphincter muscles firm, the baby can be removed from the platform and can enjoy normal food and normal spatial orientation. Because of the length of stay, there is provided a cloth covering 21 on the pad 20 to allow for ready cleaning or sterilization. Additionally, the ventilation holes 40 will help to ventilate the foam pad 20.

From the foregoing, it is apparent that the objects of the present invention have been fully accomplished. As a result of the present invention, there is thus provided a new support platform for treating the gastroesophageal reflux condition in infants. A preferred embodiment of this invention having been described and illustrated, it is to be realized that the same is not limited to the particular configuration shown in the drawings, and that modifications thereof are contemplated and can be made without departing from the broad spirit and scope of this invention as defined in the appended claims.

What is claimed is:

1. An arrangement for supporting an infant to relieve pressure on the abdominal region of the infant, comprising:

a. a contoured substantially planar support platform having an indentation transversely extending therein;

b. means for tiltably supporting said platform about a horizontal, transversely extending axis;

c. means for fastening said support platform relative to said supporting means at predetermined angles of inclination;

d. and means for restraining the infant on said support platform.

2. An arrangement as claimed in claim 1, comprising a cloth-covered foam pad being positioned on said support platform.

3. An arrangement as claimed in claim 2, said cloth covering on said foam pad being a washable fabric.

4. An arrangement as claimed in claim 1, said means for fastening said support platform relative to said supporting means comprising a friction pivot having a high-torque actuating knob for releasably fastening said support platform in a plurality of inclined positions.

5. An arrangement as claimed in claim 4, said support platform being inclined within a range of about 0° to 60° relative to the horizontal.

6. An arrangement as claimed in claim 5, said support platform being inclined at an angle of about 45° relative to the horizontal.

7. An arrangement as claimed in claim 1, comprising an upright removable support post being formed centrally of said support platform contoured to be straddled by the legs of the infant; and said indentation formed in said support platform adjacent to said support post for receiving and supporting the infant's buttocks.

8. An arrangement as claimed in claim 7, comprising an extension fastenable on said support post for adjusting the size thereof.

9. An arrangement as claimed in claim 1, said support platform having a plurality of ventilating apertures formed therein.

10. An arrangement as claimed in claim 1, said support platform comprising a generally rigid plastic material.

11. An arrangement as claimed in claim 1, said infant restraining means comprising first strap means for encompassing the abdominal region of the infant; and strap means extending across the upper chest of the infant.

12. An arrangement as claimed in claim 1, said infant restraining means comprising shoulder strap means extending about the infant's arms.

13. An arrangement as claimed in claim 1, said means for tiltably supporting said platform comprising a detachable tubular support frame structure.

14. An arrangement as claimed in claim 1, said support platform having a generally oblong, ovoid configuration.

* * * * *